US006582324B2

(12) United States Patent
Moriyama et al.

(10) Patent No.: US 6,582,324 B2
(45) Date of Patent: Jun. 24, 2003

(54) THREAD-WOUND GOLF BALL

(75) Inventors: Keiji Moriyama, Kobe (JP); Kazuhiko Isogawa, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 10/174,961

(22) Filed: Jun. 20, 2002

(65) Prior Publication Data

US 2003/0013550 A1 Jan. 16, 2003

(30) Foreign Application Priority Data

Jun. 22, 2001 (JP) ..... 2001-189817

(51) Int. Cl.[7] ..... A63B 37/06; A63B 37/12
(52) U.S. Cl. ..... 473/356; 473/356; 473/378
(58) Field of Search ..... 473/357, 356, 473/362, 365

(56) References Cited

U.S. PATENT DOCUMENTS 5,848,942 A 12/1998 Kato
5,853,337 A 12/1998 Moriyama et al.
6,319,151 B1 * 11/2001 Sugimoto ..... 473/356
6,361,455 B1 * 3/2002 Takemura ..... 473/351

FOREIGN PATENT DOCUMENTS

JP 10-201881 8/1998

* cited by examiner

*Primary Examiner*—Paul T. Sewell
*Assistant Examiner*—Tom P Duong
(74) *Attorney, Agent, or Firm*—Birch Stewart Kolasch & Birch LLP

(57) ABSTRACT

A thread-wound golf ball exhibiting favorable shot feeling and long flight distance as well as superior spin performance has a cover wrapping around a rubber thread layer formed by winding rubber thread around the center. The ratio of the volume of the rubber thread layer to the entire volume of the golf ball is 10–20%. When the deformation (mm) from the state of applying a load of 98N to a load of 1274N to the center is A, and the deformation (mm) from the state of applying a load of 98N to a load of 1274N to a thread-wound core having rubber thread wound around the center is B, the difference (A–B) is 0.5–0.7. The cover is formed of a composition including thermosetting resin as the main component. The shore D hardness of the cover is 50–60.

3 Claims, 1 Drawing Sheet

THREAD-WOUND GOLF BALL

BACKGROUND OF THE INVENTION

1. Field of the Invention

The present invention relates to a golf ball of a multilayer structure having a rubber thread layer wrapped around the center, exhibiting favorable spinning performance and shot feeling as well as a long flight distance.

2. Description of the Background Art

A golf ball of a multilayer structure having a rubber thread layer is configured by wrapping a cover around a rubber thread layer formed by having rubber thread wound around a solid center or a liquid center in an elongated state. Such a golf ball of a multilayer structure having a rubber thread layer is superior to a two-piece golf ball with a cover wrapped around a solid core in the shot feeling and controllability. However, the spin rate is high and the flight distance cannot be easily increased due to the small launch angle. Amateur golf players generally have a tendency for the two-piece golf ball that exhibits longer flight distance than the golf ball of a multilayer structure having a rubber thread layer.

Several approaches have been made to increase the flight distance of a conventional thread-wound golf ball with a solid center. For example, U.S. Pat. No. 5,848,942 discloses the definition of the center diameter to 30–38 mm, and the center hardness distribution, the cover flexural modulus and the like to a predetermined range. U.S. Pat. No. 5, 853,337 discloses the approach of using a cover of high hardness as well as the definition of the center diameter to 30–38 mm and defining the difference between the load deformation of the center and the load deformation of the ball. Japanese Patent Laying-Open No. 10-201881 discloses the definition of the load deformation of the center, the cover hardness, and the flexural modulus to a predetermined range with the center diameter set to 30–38 mm. However, the disclosed art cannot improve the flight distance while maintaining the superior spin performance of a thread-wound golf ball.

SUMMARY OF THE INVENTION

An object of the present invention is to provide a thread-wound golf all exhibiting favorable spin performance and shot feeling with a long light distance equal to or longer than the flight distance by a two-piece solid golf ball by increasing the adherence between a rubber thread layer and cover in a golf ball of a multilayer structure having a rubber thread layer.

The thread-wound golf ball of the present invention has a cover wrapped around a rubber thread layer formed by winding rubber thread around the center. The ratio of the volume of the rubber thread layer to the volume of the entire thread-wound golf ball is 10–20%. When the deformation (mm) from the state of applying a load of 98N to a load of 1274N to the center is A, and the deformation (mm) from the state of applying a load of 98N to a load of 1274N to a thread-wound core having rubber thread-wound around the center is B, the difference in deformation (A–B) is 0.5–0.7. The shore D hardness of the cover is 50–60.

It is preferable that the thickness of the cover is 1.0–2.0 mm, and the deformation (mm) A from the state of applying a load of 98N to a load of 1274N to the center is 3.5–4.1. Also, it is preferable that the deformation (mm) B from the state of applying a load of 98N to a load of 1274A to the thread-wound core having rubber thread-wound around the center is 2.7–3.4.

The foregoing and other objects, features, aspects and advantages of the present invention will become more apparent from the following detailed description of the present invention when taken in conjunction with the accompanying drawing.

DESCRIPTION OF THE PREFERRED EMBODIMENT

Figure 1:
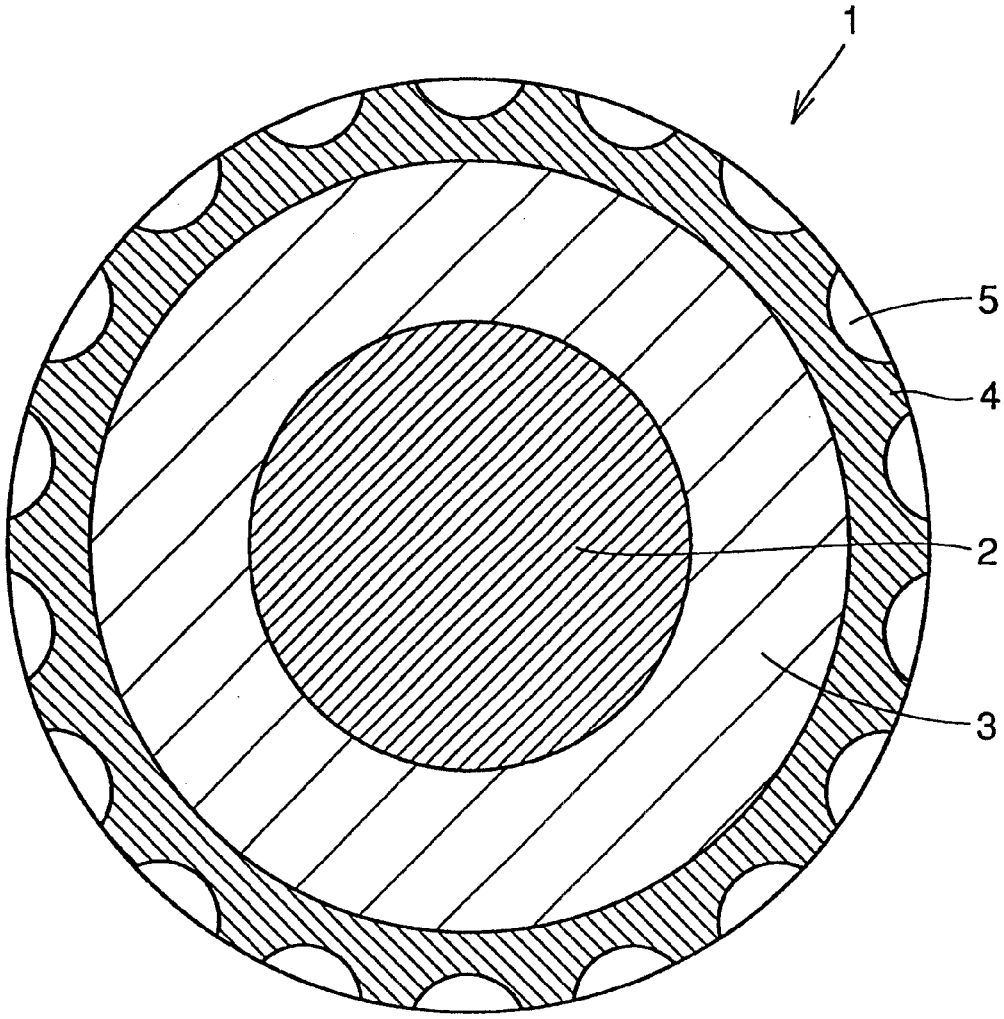
FIG. 1 is a sectional view of a golf ball of the present invention.

The present invention is directed to a thread-wound golf ball achieving long flight distance with the rebound performance and initial condition of the golf ball improved while maintaining the spin performance by establishing balance between the ratio of the volume of the rubber thread layer having rubber thread wound around a solid center to the entire volume of the golf ball and the tension of the wound rubber thread (here, this tension is indicated by the difference between the load deformation of the center and the load deformation of the thread-wound core). In the present invention, the ratio of the rubber thread layer volume to the golf ball volume is 10–20%.

It is to be noted that a thread-wound golf ball easily spins. By defining the volume ratio of the rubber thread layer to be within the above range, the spin rate when a golf ball is hit by a club of high head speed can be reduced. If the ratio of the rubber thread layer volume is less than 10%, the spin performance inherent to a thread-wound golf ball when hit with a short iron cannot be maintained. If the ratio of the rubber thread layer volume is greater than 20%, the flight distance cannot be increased since the spin rate of the golf ball when hit with a club of a high head speed cannot be reduced. The volume ratio of the rubber thread layer is preferably 12.0–19.5%, particularly 12.0–15.0%. Here, the volume of the rubber thread layer is defined as the volume of the region between the outer surface of the center and the boundary between the rubber thread layer and cover. In the case where the cover penetrates into the rubber thread layer, said boundary between the rubber thread layer and cover implies the phantom line connecting the outermost surface of the rubber thread layer.

When the deformation (mm) from the state of applying a load of 98N to a load of 1274N to the center is A, and the deformation (mm) from the state of applying a load of 98N to a load of 1274N to the thread-wound core having rubber thread wound around the center is B in the present invention, the difference between these deformation (A–B) is set to be within the range of 0.5–0.7. By setting this deformation difference in the aforementioned range, long flight distance can be achieved by increasing the tension of the rubber thread layer with smaller amount of the rubber thread layer and reducing the spin and increasing the golf ball rebound performance when hit with a club of a high head speed.

If the deformation difference (A–B) is below 0.5, the golf ball rebound performance cannot be increased. If the deformation difference (A–B) is greater than 0.7, the durability of the golf ball per se will be degraded since the rubber thread is subjected to strain due to the small amount of the rubber thread layer. The deformation difference (A–B) is more preferably within the range of 0.5–0.6.

The value of the deformation (mm) A from the state of applying a load of 98N to a load of 1274N to the center is preferably within the range of 3.5–4.1, which is smaller than that of a conventional golf ball. If the deformation A of the center is lower than 3.5, the center will become harder and the spin rate is increased. A hard shot feeling is obtained, likewise that of a two-piece solid ball. If the deformation amount A of the center is greater than 4.1, sufficient rebound performance of a golf ball cannot be obtained although a soft shot feeling will be obtained. Increase in the flight distance cannot be expected.

In the present invention, deformation B from the state of applying a load of 98N to a load of 1274N to the thread-wound core is preferably within the range of 2.7–3.4, more preferably in the range of 2.9–3.2. If the deformation amount B is smaller than 2.7, the shot feeling is hard. If the deformation amount B exceeds 3.4, the rebound performance will not be high enough. Sufficient flight distance cannot be easily achieved.

The center diameter is preferably set to 36.5–38.5 mm in the present invention. If the diameter of the center is smaller than 36.5 mm, the spin rate is increased and the launch angle will be of a level equal to that of a conventional golf ball. Therefore, the flight distance cannot be increased. If the diameter of the center is larger than 38.5 mm, the wound of the rubber thread will be finished before tension is applied on the rubber thread due to the thinner rubber thread layer. This means that an appropriate hardness cannot be applied to the golf ball. Increase in the flight distance cannot be expected.

Although high cis polybutadiene is most suitable for the rubber component of the rubber composition of the center, a composition with natural rubber, polyisoprene rubber, styrene-butadiene or the like blended with high cis polybutadiene may be employed.

The above-described rubber composition for the center has a metal salt of α, β-unsaturated carboxylic acid blended as the co-crosslinking agent. Here, sodium salt, zinc salt or magnesium salt and the like such as of acrylic acid or methacrylic acid can be used for the α, β-unsaturated carboxylic acid metal salt. The blended amount of metal salt of α, β-unsaturated carboxylic acid in the rubber composition of the center is preferably 5–40 parts by weight, further preferably 10–35 parts by weight with respect to 100 parts by weight of the rubber component. If the blended amount of the metal salt of α, β-unsaturated carboxylic acid is lower than 5 parts by weight, the center will become so soft that it may not differ from the conventional golf ball in performance. If the blended amount of the metal salt of the α, β-unsaturated carboxylic acid is greater than 40 parts by weight, the center will become so hard that the shot feeling of the golf ball may be degraded.

The rubber composition of the center includes organic peroxide as the crosslinking initiator, such as dicumyl peroxide, 1,1-bis(t-butylperoxy)-3,3,5-trymethylcyclohexane, 2,5-dimethyl-2,5-di(t-butylperoxy) hexane, di-t-butylperoxide or the like. Although the blended amount of this organic peroxide is not particularly limited, the amount is preferably 0.5–3 parts by weight with respect to 100 parts by weight of the rubber component.

The rubber composition of the center can include a filler, such as zinc oxide, barium sulfate, calcium carbonate, or the like. Although the blended amount of the filler is not particularly limited, it is preferably 5–40 parts by weight with respect to 100 parts by weight of the rubber component.

The center can be fabricated by vulcanization molding of the rubber composition of the center in a sphere. Press-molding can be generally employed in this vulcanization. The vulcanization by press-molding is effected by filling a mold with the above-described rubber composition of the center and applying heat at generally 140–180° C. for 10–60 minutes under pressure. The heating process during this vulcanization molding can be carried out in one step or in two steps.

The thread-wound core of the present invention is obtained by winding rubber thread around the above-described center with tension. The conventionally employed rubber composition can be used for the rubber thread in the formation of the rubber thread layer. For example, the rubber wound core can be obtained by vulcanizing a rubber composition having natural rubber or a blend of natural rubber and polyisoprene mixed with sulfur, a vulcanization accelerator, an antioxidant or the like.

The diameter of the thread-wound core is preferably in the range of 38.8–40.8 mm, particularly 39.6–40.4 mm. If the diameter is less than 38.8 mm, the cover will become so thick that the spin rate is increased in accordance with the soft center. Therefore, the flight distance cannot be increased. If the diameter of the thread-wound core exceeds 40.8 mm, the spin performance when hit with a short iron is degraded.

The hardness of the cover is 50–60 in shore D hardness. If the cover shore D hardness is greater than 60, the golf ball will become so hard that the shot feeling and the spin performance are degraded. If the shore D hardness of the cover is smaller than 50, the spin rate when hit at a high head speed is increased. Therefore, the flight distance cannot be increased. Preferably, the shore D hardness is 50–58, more preferably 50–55, particularly preferably 51–54.

The thickness of the cover of the present invention is preferably 1.0–2.0 mm. If the cover thickness is less than 1.0 mm, the spin performance is degraded. If the cover thickness is larger than 2.0 mm, the rebound performance is degraded due to the aforementioned low cover hardness although the spin performance with a short iron is improved. A desirable flight distance cannot be expected.

The main material of the cover of the gold ball of the present invention is thermosetting resin. Here, polyurethane resin, phenol resin, urea resin, melamine resin, unsaturated polyester resin, alkyd resin, epoxy resin and the like can be used for the thermosetting resin. Particularly, polyurethane resin is preferable.

The polyurethane resin is formed of a polyurethane composition for the cover, including isocyanate group terminated urethane prepolymer and a curing agent. The isocyanate group terminated urethane prepolymer is not particularly limited as long as it has at least two isocyanate groups in the urethane prepolymer molecule chain. The position of the isocyanate group in the urethane prepolymer molecule chain is not particularly limited. It may be located at the terminal of the main chain or the terminal of the side chain of the urethane prepolymer molecule. The aforementioned isocyanate group terminated urethane prepolymer can be obtained by effecting a reaction so that the isocyanate group in the polyisocyanate compound becomes excessive in mole ratio with respect to the hydroxyl group of polyol. The polyisocyanate compound is not particularly limited, and aromatic diisocyanate such as 2,4-tolylene diisocyanate, 2,6-tolylene diisocyanate, a mixture (TDI) of 2–4 tolylene diisocyanate and 2,6-tolylene diisocyanate, 4,4'-diphenylmethane diisocyanate (MDI), 1,5-napthylene diisocyanate (NDI), 3,3'-dimethyl-4,4'-biphenyl diisocyanate (TODI), xylylene diisoscyanate (XDI), paraphenylene diisocyanate (PPDI); alicyclic diisocyanate such as 4,-4'-di-cyclo hexylmethane diisocyanate (hydrogenated MDI), isophorone diisocyanate (IPDI), or aliphatic diisocyanate such as hexamethylene diisocyanate (HDI) and the like can be enumerated. The above-described polyisocyanate compound can be used in singularity or as a mixture of at least two types. TDI or hydrogenated MDI or polyisocyanate with these as the main component is preferable from the standpoint that the obtained polyurethane cover has favorable mechanical characteristics and rebound performance, as well as weather resistance and water resistance of the golf ball. In the present invention, the mixture of tolylene diisocyanate type urethane prepolymer or tolylene diisocyanate type urethane prepolymer and 4-4'- di-cyclo hexylmethane diisocyanate type urethane prepolymer is suitable.

The above-mentioned tolylene diisocyanate type urethane prepolymer and 4-4'-di-cyclo hexylmethane diisocyanate type urethane prepolymer refer to isocyanate group terminated urethane prepolymer obtained by the reaction of TDI or a polyisocyanate compound with TDI as the main component and 4,4'-di-cyclo hexylmethane diisocyanate (hydrogenated MDI) or a polyisocyanate compound with hydrogenated MDI as the main component and polyol.

The polyol may be a low molecular weight compound or a high molecular weight compound as long as a plurality of hydroxyl groups are included. As the polyol of low molecular weight, diol such as ethylene glycol, diethylene glycol, triethylene glycol, 1,3-butane diol, 1,4-butane diol, neopenthyl glycol, 1,6-hexane diol; triol such as glycerine, trimethylol propane, and hexane tiol and the like can be enumerated.

As the polyol of a high molecular weight, polyether polyol that can be obtained by the reaction between the initiator having active hydrogen and alkylene oxide; condensed type polyester polyol obtained by dehydration condensation of dibasic acid such as adipic acid and glycol or triol; lactone type polyester polyol obtained by the ring-opening polymerization of lactam such as ϵ-caprolactam; polycarbonate diol synthesized using cyclic diol; and polymer polyol such as acryl polyol having an appropriate hydroxyl group introduced into an acryl type copolymer can be enumerated.

As the polyether polyol, polyoxyethylene glycol, polyoxypropelene glycol (PPG), polyoxy tetramethylene glycol (PTMG) and the like can be enumerated. As the condensed type polyester polyol, polyethylene adipate (PEA), polybutylene adipate (PBA), polyhexamethylene adipate (PHMA) and the like can be enumerated. As the lactone type polyester polyol, poly-ϵ-caprolactone (PCL) and the like can be enumerated. From the standpoint of superior rebound performance and waterproof property, preferably polyethyl polyol, more preferably polyoxy tetramethylene glycol is used.

As a combination of the aforementioned polyisocyanate and polyol, the combination of a polyisocyanate compound with TDI, hydrogenated MDI or both as the main component and polyoxy tetramethylene glycol is preferable. Specific examples of the isocyanate group terminated urethane prepolymer includes those sold under the name of "Adiprene" from Uniroyal Inc. such as Adiprene LF900A, Adiprene LF930A, Adiprene LF950A, Adiprene LF0330, Adiprene L200, and the like.

The curing agent used in the present invention includes a glycol type or amine type curing agent. As the glycol type curing agent, 1,4-butane diol, 1,3-butane diol, 2,3-butane diol, 2,3-dimethyl-2,3-butane diol, dipropylene glycol, ethylene glycol and a mixture thereof can be enumerated.

As the amine type curing agent, the diphenylmethane type such as 3,3'-dichloro-4-4'-diamino diphenylmethane (MOCA), 2,2 dichloro-3,3', 5,5'-tetra ethyl-4,4'-diamino diphenylmethane; the toluene diamine type such as 3,5-dimethyl thio-2,4-toluene diamine, 3,5-diethyl-2,4-toluene diamine; the benzoate type such as trimethylene glycol-di-p-amino benzoate, polytetramethylene glycol-di-p-amino benzoate and the like can be enumerated. In the present invention, the diphenylmethane type and benzoate type amine curing agent are preferable. 2,2'-dichloro-3,3', 5,5'-tetraethyl-4,4'-diamino diphenylmethane and polytetramethylene glycol-di-p-amino benzoate are more preferable. The blending amount of the aforementioned curing agent is not particularly limited. Although it is preferable to blend so that $NH_2$/NCO is from 0.85 to 1.15 in mole ratio with respect to the isocyanate group terminated urethane prepolymer, the aforementioned range may be exceeded if desired. As specific examples of the curing agent, the amine type curing agent sold under the product name of "Lonza cure M-CDEA" from Uniroyal Inc., the amine type curing agent sold under the product name of "Polamine 250P" from Air Products Inc. can be enumerated.

The polyurethane cover composition employed in the present invention can include the general catalyst employed in the reaction of polyurethane. As this catalyst, the tertiary amine type catalyst, organic metal type catalyst, or the like can be used. As the tertiary amine type catalyst, triethylamine, triethylenediamine, N,N,N',N",N"-penta methyl diethylenetriamine, N,N-diethylethanolamine, ethyl morpholine and the like can be enumerated. Also, the blend of tertiary amine, and ethylene glycol, dipropylene glycol, 1,4-butanediol, N,N-dimethylethanolamine can be enumerated. As the organic metal type catalyst, a tin type catalyst such as dibutyl tin dilaurylate, dibutyl tin diacetate or the like can be enumerated. In the present invention, the blend of triethylenediamine and dipropylene glycol is preferable. As a specific example of the catalyst, a catalyst sold under the product name of "DABCO 33-LV" from Air Products Inc. can be enumerated.

The cover employed in the present invention can have various additives included as necessary other than the above described resin. For example, a pigment such as titanium dioxide, a dispersing agent, an anti-oxidant, an ultraviolet absorbent, a photo-stabilizer and the like can be added.

The method of wrapping the above-described cover around the rubber thread layer includes the steps of pouring the cover composition such as thermosetting polyurethane resin into a dimpled mold having a hemispherical cavity holding a thread-wound core, inverting this mold and pouring the cover composition into another dimpled mold having a hemispherical cavity, closing both molds together and heat-pressing in the mold for 0.5–3 minutes at 50–150° C. for curing. Here, the molding temperature is preferably in the range of 50–100° C.

The thread is wound at the tension of 40–90 kgf/cm$^2$ for the thread-wound core. By this high tension, a hard ball can be obtained. In conventional formation, the molding temperature is of a high level of at least 140° C. since ionomer or thermoplastic elastomer or a blend thereof is employed. There was a tendency of degradation in the rebound performance of the ball due to degradation of the rubber thread caused by the heat during molding. In the present invention, molding temperature can be reduced by using thermosetting resin. Accordingly, the rebound performance of the golf ball can be improved since degradation of the rubber thread can be alleviated.

In the formation process of the cover, dimples are formed, as necessary, on the surface of the golf ball. Following the cover formation, the golf ball is applied with paint and stamped with marking.

The diameter of the thread-wound golf ball of the present invention is set to generally to the range of 42.67–42.93 mm, particularly to the range of 42.67–42.82. The deformation (mm) C from the state of applying a load of 98N to a load of 1274N to the golf ball is preferably in the range of 2.6–3.3, more preferably 2.8–3.1. If the deformation C is below 2.6, the shot feeling will be hard. If the deformation C exceeds 3.3, the rebound performance is degraded.

By establishing the relationship of A>B>C for center deformation A, thread-wound core deformation B and golf ball deformation C set forth above, the compression hardness distribution of the entire golf ball will exhibit hardness at the outer side and softness at the inner side. When the golf ball is hit with a club head of high head speed, the ball will fly with low spinning to allow the flight distance to be increased. Furthermore, the difference between the deformation B and deformation C is preferably set to $0<(B-C)<0.3$, particularly to $0<(B-C)<0.2$. If the difference attains a negative level, the spin rate is increased when the golf ball is hit at a high head speed. Accordingly, increase of the flight distance cannot be expected. If this difference exceeds 0.3, the spin performance when hit with a short iron will be degraded.

The general structure of a thread-wound golf ball of the present invention will be described with reference to FIG. 1. FIG. 1 is a schematic sectional view of an example of a golf ball of the present invention. Referring to FIG. 1, 1 designates a golf ball, 2 designates the center, 3 designates the rubber thread layer, 4 designates the cover, and 5 designates a dimple. Rubber thread layer 3 is formed by winding rubber thread around center 2 in an elongated state. Center 2 and rubber thread layer 3 form the thread-wound core. Rubber thread layer 3 is surrounded by cover 4. The arrangement and number of dimples 5 formed correspond to the desired characteristics.

EXAMPLE

The present invention will be described specifically based on Examples.

(1) Fabrication of Center

For respective centers of Examples 1–5 and Comparative Examples 1 and 2, the blend numbers 1–7 of the blended composition shown in Table 1 were prepared. The blended amount of each component noted in Table 1 is indicated by "parts by weight". The rubber composition of the center was introduced into a mold and subjected to vulcanization molding under pressure to produce the center. Vulcanization was effected for 23 minutes at 160° C. The diameter and deformation of the obtained center are shown in Table 4. The deformation of the center noted in Table 4 is the measurement of the deformation from the state of applying a load of 98N to a load of 1274N to the center.

TABLE 1

(1) Center Ingredient and Vulcanization Condition

| | Blend·Molding Condition/Blend No. | | | | | | |
|---|---|---|---|---|---|---|---|
| | 1 | 2 | 3 | 4 | 5 | 6 | 7 |
| BR18 note 1) | 100 | 100 | 100 | 100 | 100 | 100 | 100 |
| zinc acrylate | 26 | 28 | 26 | 26 | 28 | 28 | 26 |
| zinc oxide | 8.4 | 7.4 | 8.4 | 5.8 | 7.4 | 10.2 | 10.8 |
| barium sulfate | 20.8 | 20.8 | 20.8 | 20.8 | 20.8 | 20.8 | 20.8 |
| diphenyldisulfide | 0.5 | 0.5 | 0.5 | 0.5 | 0.5 | 0.5 | 0.5 |
| dicumylperoxide | 0.9 | 0.9 | 0.9 | 0.9 | 0.9 | 0.9 | 0.9 |

TABLE 1-continued (1) Center Ingredient and Vulcanization Condition

| | Blend·Molding Condition/Blend No. | | | | | | |
|---|---|---|---|---|---|---|---|
| | 1 | 2 | 3 | 4 | 5 | 6 | 7 |
| molding condition | | | | | | | |
| temperature (° C.) | 160 | 160 | 160 | 160 | 160 | 160 | 160 |
| time (minute) | 23 | 23 | 23 | 23 | 23 | 23 | 23 |

Note 1)cis-1-4-polybutadiene of Nippon Synthetic Rubber Co. Ltd. (Cis content at least 90%)

(2) Fabrication of Thread-Wound Core

The thread-wound cores of Examples 1–5 and Comparative Examples 1 and 2 were prepared as set forth below. As the rubber component around the above-described center, a rubber composition with natural rubber/low cisisoprene rubber blended at 40/60 parts by weight was vulcanized. Rubber thread of 1.5 mm in width and 0.5 mm in thickness was wound to form the thread-wound core of respective diameters and deformation shown in Table 4.

(3) Cover

Examples 1–5

Each of the ingredients of the cover blend shown in Table 3 (No. 1-No. 5) were poured into a dimpled mold having a hemispherical cavity holding the above-described thread-wound core. Then, the mold was inverted. The same cover blend was poured into another dimpled mold having a hemispherical cavity. Both molds were closed together and subjected to heat pressing under the molding condition shown in Table 3 (70° C. for 10 minutes or 110° C. for 5 minutes) for curing. A cover layer of a predetermined thickness was formed.

Comparative Examples 1 and 2

Using the cover material of Table 2 and the cover blends (No. 6, No. 7) of Table 3, half shells of respective covers were formed by injection molding. The above-described thread-wound core was enclosed by two of the formed half shells. Press formation was applied for 2 minutes at 150° C. with a golf ball mold to wrap the thread-wound core with a cover. The temperature was reduced to 20° C. by introducing cooling water.

Paint was applied on the cover surface of the golf ball of the above Examples of the present invention and Comparative Examples to produce golf balls of 42.75 mm in diameter.

TABLE 2

| Name | Metal Type | Hardness (Shore D) | Flexural Modulus ($Kg/cm^2$) | Component | Company Name |
|---|---|---|---|---|---|
| Surlyn 9945 | Zn | 59 | 2,255 | Zn neutral ethylene/methacrylic acid copolymer binary ionomer | Sankyo-Dupont Polychemical Co. Ltd. |
| Surlyn 8945 | Na | 61 | 2,775 | Na neutral ethylene/methacrylic acid copolymer binary ionomer | Sankyo-Dupont Polychemical Co. Ltd. |
| Epofriend A1010 | — | 70[note 1)] | — | Epoxidized SBS with epoxy-modified styrene/butadiene/styrene (Rubber component/styrene ratio = 60/40) | Daicel Chemical Industries Ltd. |
| Septon HG252 | — | 80[note 1)] | — | OH group binded to terminal of hydrogenated polystyrene block-isoprene/butadiene random polymer block copolymer | Kuraray Co. Ltd. |
| Adiprene LF900A | TDI/PTMG Type Urethane Prepolymer | | | | Uniroyal Inc. |
| Adiprene LF950A | TDI/PTMG Type Urethane Prepolymer | | | | Uniroyal Inc. |
| Lonza cure | 2, 2 dichloro-3, 3', 5, 5'-tetraethyl-4 4'-diaminodiphenylmethane | | | | Uniroyal Inc. |

note 1)JIS-A hardness

TABLE 3

| Cover Ingredient and Molding Condition | Blend·Molding Condition/Blend No. | | | | | | |
|---|---|---|---|---|---|---|---|
| | 1 | 2 | 3 | 4 | 5 | 6 | 7 |
| (Thermosetting Resin) | | | | | | | |
| Adiprene LF900A | 60 | 80 | 60 | 60 | 80 | — | — |
| Adiprene LF950A | 40 | 20 | 40 | 40 | 20 | — | — |
| Lonza cure | 19.8 | 17.8 | 19.8 | 19.8 | 17.8 | — | — |
| (Thermoplastic resin) | | | | | | | |
| Surlyn 8945 | — | — | — | — | — | 30 | 30 |
| Surlyn 9945 | — | — | — | — | — | 30 | 30 |
| Septon HG252 | — | — | — | — | — | 30 | 30 |
| Epofriend A1010 | — | — | — | — | — | 10 | 10 |
| Titanium oxide | — | — | — | — | — | 4 | 4 |
| Surnol LS770 [note 1)] | — | — | — | — | — | 0.2 | 0.2 |
| Molding condition | | | | | | | |
| Temperature (° C.) | 70 | 70 | 70 | 70 | 110 | 150 | 150 |
| Time (minute) | 10 | 10 | 10 | 10 | 5 | 2 | 2 |

Note 1)Surnol LS770: Antioxidant of Sankyo Co.

The golf balls were assessed according to the following manner.

<Hit Test by Driver>

A metal head driver (of Sumitomo Rubber Ind.: XXIO W#1, loft 8 degrees, X shaft) was attached to a swing robot of Golf Laboratory Inc. The golf ball was hit with the head speed set to 50 m/sec. The launch angle and the back spin rate immediately after the hit and the total flight distance were measured. Measurements were taken 12 times for each golf ball. The average thereof was taken as the measurement result of each golf ball.

<Hit Test by Sand Wedge>

A sand wedge (of Sumitomo Rubber Ind., DP-601/SW) was attached to a swing robot of Golf Laboratory Inc. Each golf ball was hit with the head speed set to 21 m/sec. The back spin rate immediately after the hit was measured. Measurements were taken 12 times for each golf ball. The average thereof was taken as the measurement result of the golf ball.

TABLE 4

| | | Examples of Invention | | | | | Comparative Examples | |
|---|---|---|---|---|---|---|---|---|
| | | 1 | 2 | 3 | 4 | 5 | 1 | 2 |
| Golf Ball Specification | | | | | | | | |
| Center | Diameter (mm) | 37 | 37 | 37 | 38.3 | 37 | 37 | 37 |
| | Deformation A(mm) | 3.9 | 3.6 | 3.9 | 4.0 | 3.6 | 3.6 | 3.9 |
| | Blend | 1 | 2 | 3 | 4 | 5 | 6 | 7 |
| Thread- | Thread-wound core diameter (mm) | 39.6 | 39.6 | 40.4 | 40.4 | 39.6 | 39.6 | 39.6 |
| Wound | Rubber thread layer thickness (mm) | 1.3 | 1.3 | 1.7 | 1.0 | 1.3 | 1.3 | 1.3 |
| Core | (Rubber thread layer volume)/(ball volume) × 100 | 14.3 | 14.3 | 19.3 | 12.2 | 14.3 | 14.3 | 14.3 |
| | Deformation B (mm) | 3.3 | 3.1 | 3.3 | 3.3 | 3.1 | 3.0 | 3.3 |
| Deformation Difference (A-B) | | 0.6 | 0.5 | 0.6 | 0.7 | 0.5 | 0.6 | 0.6 |
| Cover | Thickness (mm) | 1.6 | 1.6 | 1.2 | 1.2 | 1.6 | 1.6 | 1.6 |
| | Hardness (Shore D) | 57 | 55 | 57 | 57 | 55 | 58 | 58 |
| | Blend No. | 1 | 2 | 3 | 4 | 5 | 6 | 7 |

TABLE 4-continued

| | | Examples of Invention | | | | | Comparative Examples | |
|---|---|---|---|---|---|---|---|---|
| | | 1 | 2 | 3 | 4 | 5 | 1 | 2 |
| Ball | Diameter (mm) | 42.75 | 42.75 | 42.75 | 42.75 | 42.75 | 42.75 | 42.75 |
| | Ball deformation C (mm) | 3.0 | 2.8 | 3.1 | 3.1 | 3.0 | 2.9 | 3.2 |
| Deformation Difference (B-C) | | 0.3 | 0.3 | 0.2 | 0.2 | 0.1 | 0.1 | 0.1 |
| Performance | | | | | | | | |
| Flight Test Result | | 8.8 | 8.2 | 8.1 | 8.9 | 8.2 | 8.3 | 8.3 |
| W#1 | Launch angle (°) | | | | | | | |
| 50 m/s | Spin rate (rpm) | 2580 | 2780 | 2850 | 2420 | 2730 | 2790 | 2640 |
| | Total flight distance (m) | 262.4 | 258.8 | 257.4 | 262.9 | 256.9 | 256.3 | 251.5 |
| SW | Spin rate (rpm) | 7110 | 7200 | 7150 | 7040 | 7130 | 6880 | 6630 |
| 21 m/s | | | | | | | | |

It is appreciated from Table 4 that, since the golf balls of Comparative Examples 1 and 2 employ thermoplastic resin for the cover, the molding temperature of the cover is increased so that the rubber thread is degraded to exhibit reduction in the ball flight distance. In contrast, the golf balls of Examples 1–5 employ thermosetting resin for the cover. Therefore, the molding temperature can be lowered. Accordingly, the rubber thread is not degraded. Furthermore, by the anchor effect of the cover resin material sufficiently permeating into the void in the rubber thread, increase in durability can be expected.

According to the thread-wound golf ball of the present invention, the ratio of the volume of the rubber thread layer to the entire volume of the golf ball is set within a predetermined range. Also, the difference between the deformation of load to the center and the deformation of load to the thread-wound core is defined to a predetermined range. Furthermore, the cover is formed of thermosetting resin. Therefore, the spin performance can be maintained when hit with a short iron, and a long flight distance can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread-wound golf ball having a cover wrapped around a rubber thread layer formed by winding rubber thread around a center, wherein a ratio of a volume of said rubber thread layer to the volume of said golf ball is 10–20%, and when deformation (mm) from a state of applying a load of 98N to a load of 1274N to said center is A, and deformation (mm) from the state of applying a load of 98N to a load of 1274N to a thread-wound core having rubber thread-wound around said center is B, a difference therebetween (A–B) is 0.5–0.7, said cover being formed of a cover composition including thermosetting resin as a main component, said cover having a shore D hardness of 50–60.

2. The thread-wound golf ball according to claim 1, wherein said cover has a thickness of 1.0–2.0 mm, and said deformation (mm) A from the state of applying a load of 98N to a load of 1274N to said center is 3.5–4.1.

3. The thread-wound golf ball according to claim 1, wherein said deformation (mm) B from the state of applying a load of 98N to a load of 1274N to a thread-wound core having rubber thread-wound around said center is 2.7–3.4.

* * * * *